United States Patent [19]

Andersson et al.

[11] Patent Number: 4,477,983

[45] Date of Patent: Oct. 23, 1984

[54] METHOD OF VENTILATING CYLINDER POCKETS IN A CYLINDER DRYER AND APPARATUS FOR CARRYING OUT THE METHOD

[75] Inventors: Karl-Hugo Andersson; Nils Zinn, both of Växjö , Sweden

[73] Assignee: Flakt Aktiebolag, Nacka, Sweden

[21] Appl. No.: 311,463

[22] Filed: Oct. 14, 1981

[30] Foreign Application Priority Data

Oct. 23, 1980 [SE] Sweden ..... 8007440

[51] Int. Cl.[3] ..... F26B 13/08

[52] U.S. Cl. ..... 34/114; 34/116; 34/117; 34/123

[58] Field of Search ..... 34/116, 117, 123, 111, 34/23, 34, 41

[56] References Cited

U.S. PATENT DOCUMENTS

| | | | |
|---|---|---|---|
| 1,438,211 | 12/1922 | Baetz . | |
| 1,595,480 | 8/1926 | Minton | 34/117 |
| 3,110,575 | 11/1963 | Justus . | |
| 3,263,344 | 8/1966 | Stickle | 34/116 |
| 3,320,677 | 5/1967 | Reitzel | 34/116 |
| 3,376,653 | 4/1968 | Daane . | |
| 3,388,479 | 6/1968 | Gardner | 34/111 |
| 3,419,203 | 12/1968 | Amend, Jr. . | |
| 3,504,443 | 4/1970 | Gustafsson . | |

FOREIGN PATENT DOCUMENTS

| | | |
|---|---|---|
| 577836 | 9/1924 | France . |
| 357782 | 9/1969 | Sweden . |
| 330646 | 11/1970 | Sweden . |
| 1255920 | 12/1971 | United Kingdom . |
| 1321536 | 6/1973 | United Kingdom . |

*Primary Examiner*—Larry I. Schwartz

*Attorney, Agent, or Firm*—Dann, Dorfman, Herrell and Skillman

[57] ABSTRACT

A cylinder dryer usually includes a plurality of heated cylinders (4) about which a web-like material (1) is taken in a zig-zag mode and pressed against certain of the heated cylinder surfaces by means of an endless high-permeability wire (3), whereby cylinder pockets are formed between the cylinders (4), web (1) and wire (3), when the latter relinquishes contact with the web at a cylinder surface (6) to pass over a return roll (7) arranged between the cylinders, and once again makes contact with the web at the next following cylinder circumference (8). According to the invention these cylinder pockets are ventilated by a flow of drying air from a blowing box (9) being blown over the width of the wire against its surface facing away from the cylinder, in a direction forming an acute angle to and having a directing component substantially counter to the direction of travel of the wire. Blowing is carried out thereby within an area (6) where the wire relinquishes contact with the web. The blowing box (9) is also provided with means (11) arranged for preventing an interface layer of moist air about the circumference of the return roll being introduced into the cylinder pocket upon rotation of the return roll.

2 Claims, 9 Drawing Figures

Figure 1A:
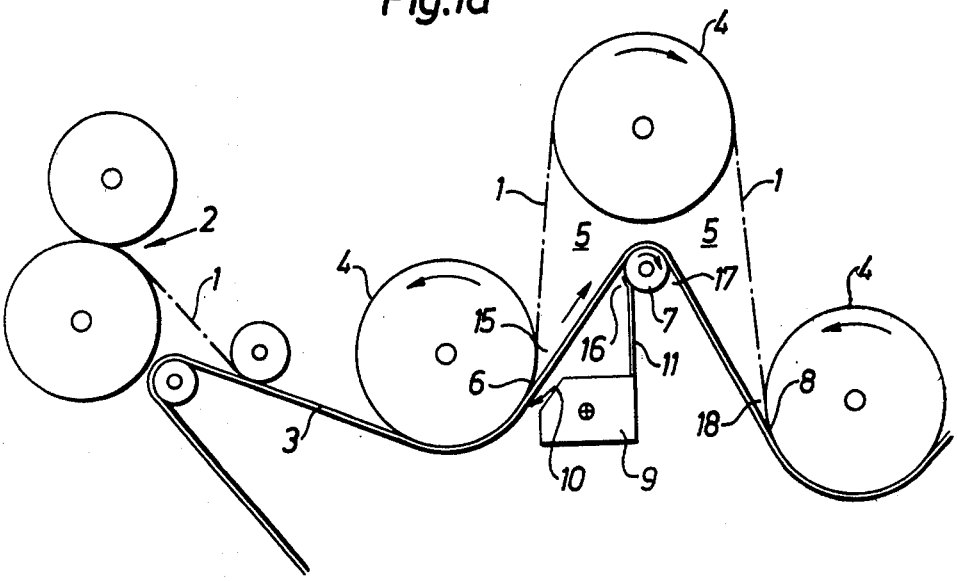

METHOD OF VENTILATING CYLINDER POCKETS IN A CYLINDER DRYER AND APPARATUS FOR CARRYING OUT THE METHOD

The present invention relates to a method of ventilating cylinder pockets in a cylinder dryer, which includes a plurality of heated cylinders about which a web-like material is taken zig-zag and is pressed against certain of the heated cylinder surfaces by means of an endless Fourdrinier wire. The cylinder pockets are formed between the cylinders, web and wire when the latter relinquishes contact with the web at a cylinder surface in order to pass over a return roll arranged between the cylinders, to once againt make contact with the web at the cylinder surface next in line. The invention also relates to apparatus for carrying out the method.

When a Fourdrinier wire is used to improve contact between the web and the heated cylinders in drying a web-like material in a cylinder dryer, there have been difficulties in obtaining uniform drying over the whole web width, i.e. to obtain a uniform drying profile, which is due to the web having a width which can attain 10 meters and more. One cause of the difficulty in obtaining a uniform drying profile is that moist air is enclosed in the pockets formed between cylinder, web and wire. Different methods have been proposed for ventilating these pockets. One method was to allow air at relatively high pressure to flow into the pocket from ejector jets arranged immediately outside the same. By disposing the jets alternatingly on the leading and trailing side of the roll a cross draught is obtained through the pocket, whereby the moisture in the air in the pockets could be balanced, which led to an improvement of the web drying profile. Another method was to instal a so-called doctor blow pipe inside the pocket and extending across the whole web width. This pipe was provided with blowing orifices which distributed the air over the web. The air distribution could be controlled so that a desired drying profile was obtained. However, these blowing pipes had the considerable disadvantage that they obstructed machine maintenance and particularly clearing up and cleaning after a web break.

In the cases where the drying wire consists of a high-permeability material allowing air passage, it is also known to place a blowing means outside the cylinder pocket so that it extends over the width of the wire and is provided with blowing orifices for blowing drying air substantially at right angles to the plane of the wire. When a high-permeability wire is used, there is a heavy pump action, striving to pump in air into the pocket and also to pump air out of it. The quantity of air supplied to the pocket is, however, substantially greater than the quantity pumped out, which gives rise to an air current passing out through the ends of the pocket at right angles to the travelling direction of the wire. The difference between pumped-in air and pumped-out air becomes greater with increased speed of the wire, and the cross air current simultaneously increases. At a given critical web speed, the cross air current will be so great that web flutter occurs within the critical end portions of the pocket, and attempts have been made to control this by altering the permeability of the wire and by moving the position of the return roll, thereby increasing the difference in quantity between pumped-in air and pumped-out air. The problems are intensified if a blowing box is placed outside the pocket to improve drying, this box blowing dry air at right angles to the wire, which further increases the quantity of air flowing into the pocket, whereas the pumped-out air quantity is kept practically constant for a given basic speed.

The object of the present invention is to provide a method of controlling the air quantity blown into the cylinder pocket so that the difference in quantity between air pumped in and air pumped out through the criticial end cross section of the pocket will be as small as possible, whereby the risk of web flutter may be eliminated.

This object is realized in accordance with the invention essentially in that a current of drying air is blown over the width of the wire against its surface facing away from the cylinder, in a direction forming an acute angle to the wire travel direction and with a directing component substantially counter-directed thereto, blowing taking place within an area where the wire relinquishes contact with the web, and for the purpose of reducing the spontaneous air inflow in the cylinder pocket brought on by the wire speed and texture, and in that for a given desired web speed the wire permeability is selected such that the difference between desired air inflow in the cylinder pocket and the spontaneous airflow out of the pocket generated by the wire speed and texture is sufficiently low for the air current thereby generated across the web not to exceed the speed at which web flutter occurs.

The invention also relates to an apparatus for carrying out the method, and this apparatus is essentially characterized in that at least some of the blowing openings of the blowing box are directed such that drying air is caused to flow towards the wire in a direction forming an acute angle to the wire travelling direction and with a directing component substantially counter-directed thereto, and in that the blowing box is provided with means adapted to prevent an interface layer of moist air about the periphery of the return roller being introduced into the cylinder pocket by the rotation of the return roll.

Figure 1B:
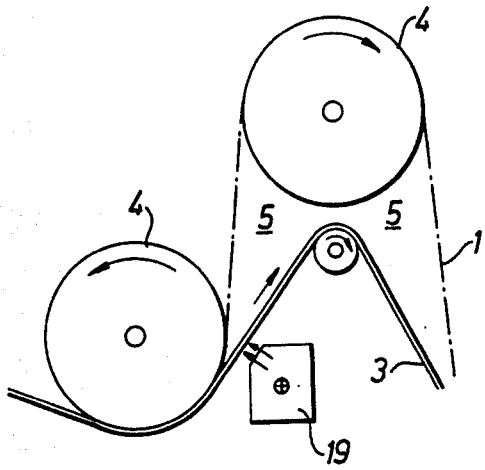
Fig.1b PRIOR ART
Figure 2:
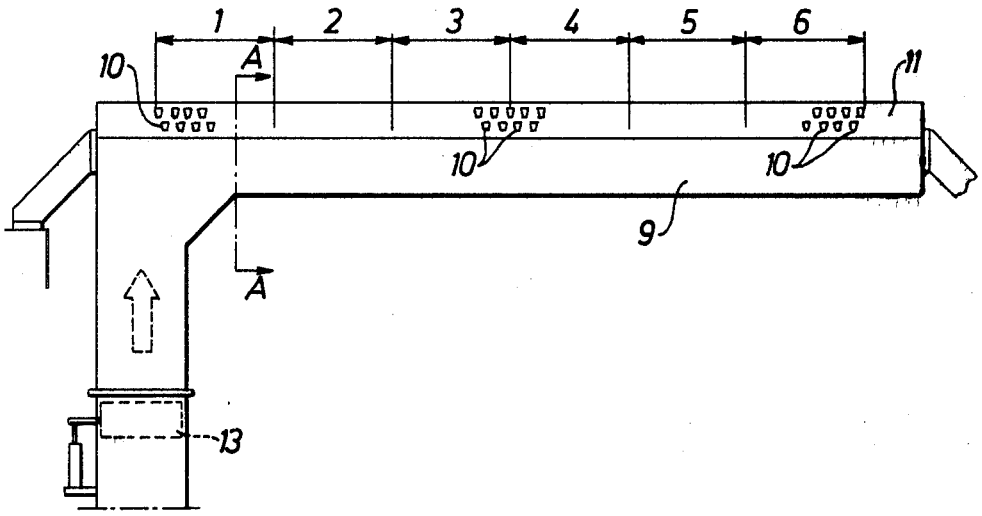
Figure 3:
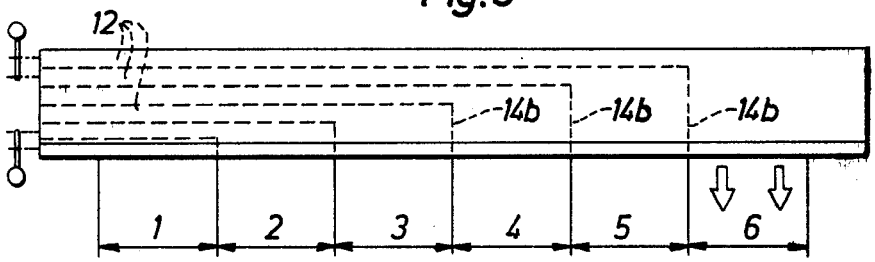
Figure 4:
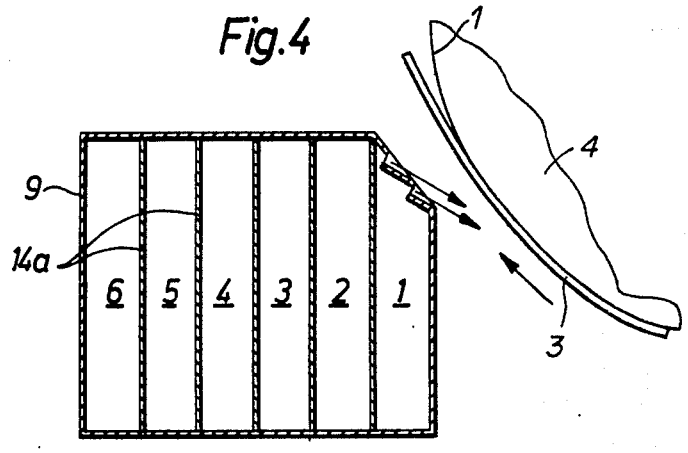
Figure 5:
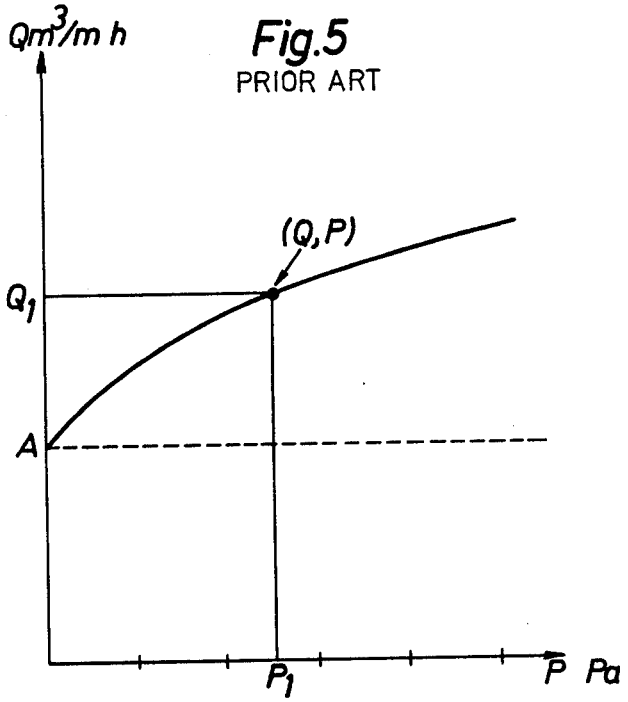
Fig.5 PRIOR ART
Figure 6:
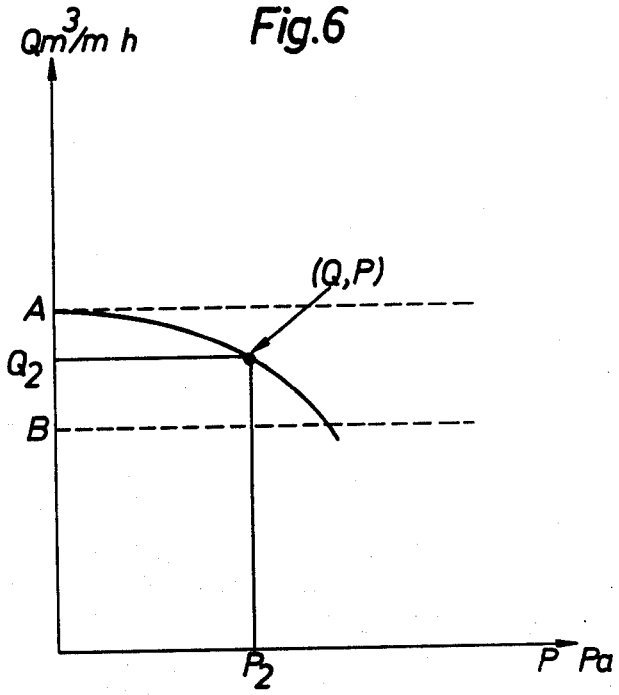
Figure 7:
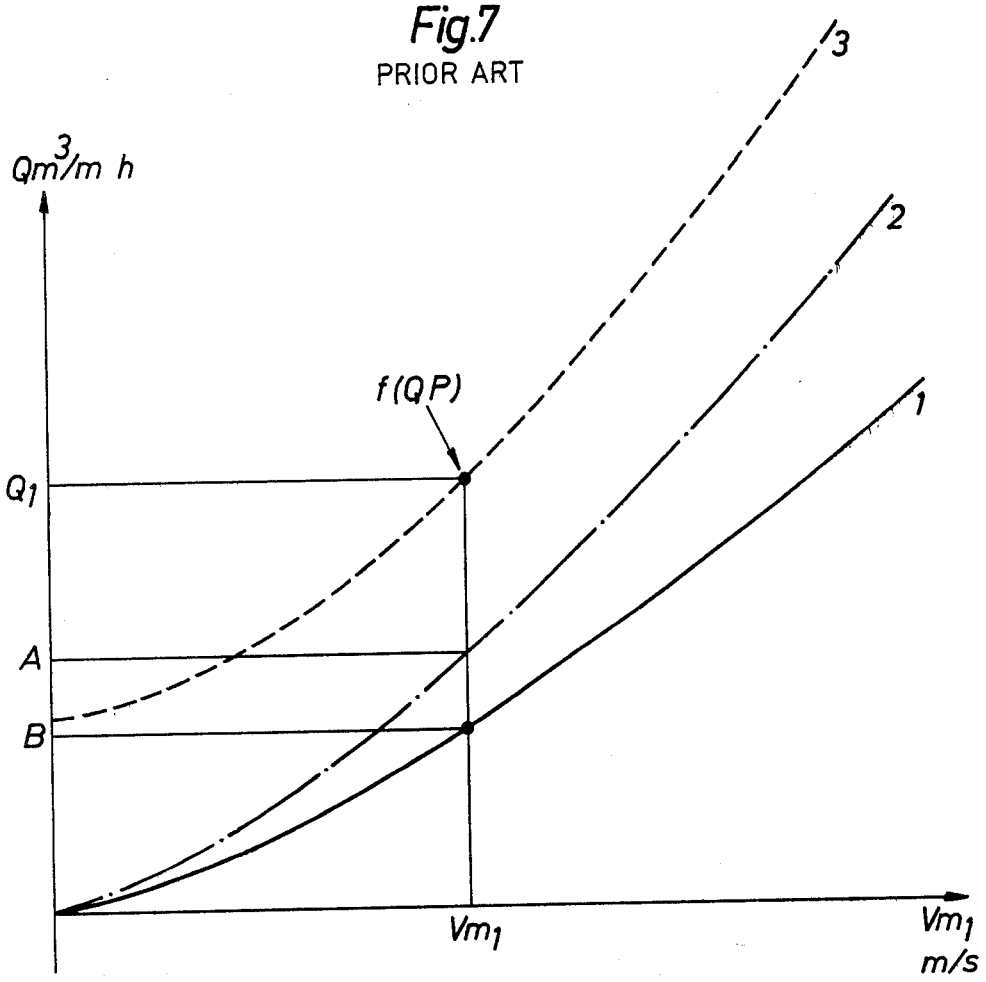
Fig.7 PRIOR ART
Figure 8:
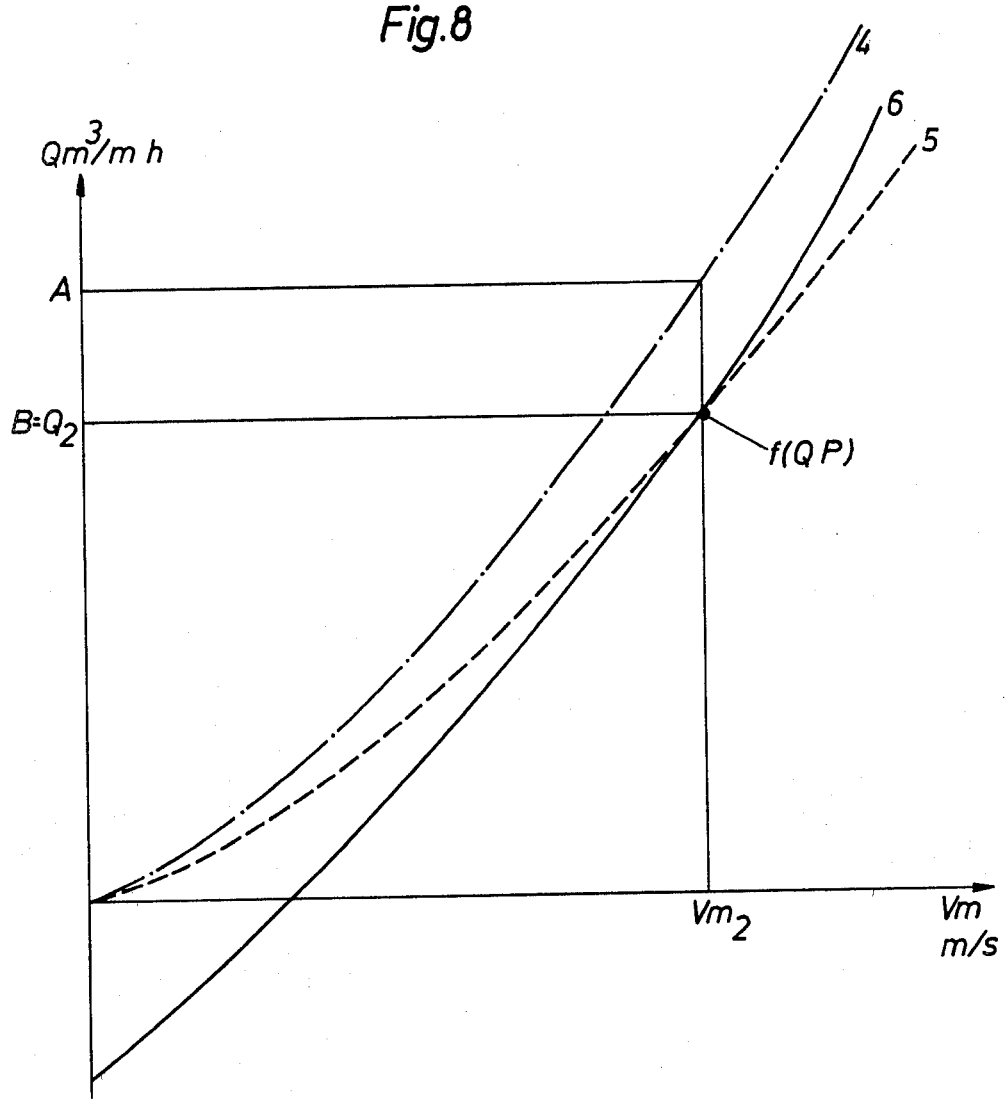

A conventional structure and an embodiment of the invention selected as an example will be described below while referring to the appended drawings, where FIG. 1*a* schematically illustrates a cylinder dryer including a blowing box for carrying out the method in accordance with the invention, FIG. 1*b* illustrates a portion of the cylinder dryer of FIG. 1*a* with a conventional blowing box, FIG. 2 illustrates the blowing box of FIG. 1*a* seen from the front, FIG. 3 illustrates the blowing box of FIG. 2 seen from above, where the sections of the blowing box have been indicated by means of dashed lines, FIG. 4 is a cross section along the line A—A in FIG. 2, FIG. 5 diagrammatically illustrates the air quantity Q, blown into the cylinder pocket, as a function of the pressure in the blowing box in a conventional blowing box according to FIG. 1*b*, with blowing at right angles to the wire, FIG. 6 illustrates the same function as in FIG. 5 for a blowing box according to FIG. 1*a*, with counter-directed blowing onto the wire, FIG. 7 illustrates the airflows to and from the cylinder pocket as a tion function of the machine speed in a conventional blowing box according to FIG. 1*b*, and FIG. 8 illustrates the same function as in FIG. 7 for counterdirected blowing by means of a blowing box according to FIG. 1*a*.

In the portion of a cylinder box illustrated in FIG. 1*a*, a material web 1 is transferred from a roll nip 2 in a wet section to the drying section, in which the web 1 is carried by a drying wire 3 in the form of an endless high-permeability Fourdrinier wire 3. The web is taken zig-zag between heated cylinders 4 and is pressed against the lower cylinders with the aid of the wire 3. Cylinder pockets 5 are thus formed between each cylinder 4 in the upper row, the web 1 and wire 3, when the latter relinquishes contact with the web at a zone 6 to pass over a return roll 7, arranged between the cylinders in the lower row, once again making contact with the web at another zone 8 at the cylinder situated next in line in the travelling direction.

An inventive blowing box 9 is placed outside the cylinder pocket and is provided with blowing orifices 10, in the present case formed as louvre-type or eyelid perforations, directed such as to cause the drying air flowing out of the box to flow towards the wire 3 in a direction counter to that of the wire travel and to form an acute angle thereto. The orifices are disposed such that blowing on the wire 3 takes place within a zone 6 where the wire relinquishes contact with the web 1. Between the return roll 7 and blowing box 9 there are sealing means 11 formed as strips of felt or brushes, made from temperature and moisture-proof material, lying against the circumference of the return roll 7 to prevent an interface layer of moist air around said circumference from being introduced into the cylinder pocket 5 through the wire 3 when the roll rotates.

A conventional blowing box 9 will be seen from FIG. 1*b* and is similarly placed outside the cavity and provided with openings for blowing perpendicularly onto the wire 3.

The blowing box structure is apparent from FIGS. 2, 3 and 4. The box 9 thus has a substantially rectangular cross-section with a bevelled edge portion in which the eyelid perforations 10 are formed. The box is further divided into six sections, in the Figure running from 1 to 6. The drying air is individually suppliable to these sections via ducts 12, each of which has an adjustable valve 13, with the aid of which the air flow to the different sections can be regulated individually to obtain the desired drying profile of the web. As will be apparent from the cross-section in FIG. 4, the different sections are formed by means of an intermediate wall 14*a* extending substantially parallel to the plane of the wire 3 and up to cross walls 14*b* which divide the edge portion into sections. The blowing openings 10 are formed such that the airstream comes over the whole width of the wire and in a direction counter to the travelling direction thereof. The blowing box 9 can also be provided with conventional openings, as shown on FIG. 1*b* to permit at least a portion of the air to be flown perpendicularly onto the wire 3. The wire consists of high-permeability material which signifies that air can flow through it. However, this flow of air results in the occurence of a heavy pumping action during operation, which strives to pump air into the pocket and also to pump air out from it. The phenomenon is generally denoted as spontaneous ventilation of the cylinder pocket, and since pumping air into the pocket is more effective than pumping air out from it, more air comes in than goes out, which causes air to flow in the transverse direction of the web and go out through the end portions of the pocket. If this transverse air current becomes too great, it can cause flutter at the outer edges of the web, which is particularly dangerous if the superficial weight of the drying material is low and the machine speed high. The cause of a greater quantity of air being pumped in than is pumped out is connected with the different dimensions of the cylinders and return rollers, resulting in that the so-called pumping-in wedges 15 and 16 are more effective than the pumping-out wedges 17 and 18. The spontaneous ventilation of the cylinder pocket increases with increasing wire permeability, and naturally also with increasing machine speed.

In FIG. 5 the pumped-in air quantity is illustrated as a function of the pressure in a blowing box of a conventional kind for a given machine speed. In such a box the drying air is caused to flow out perpendicular to the wire and thereby also increase the total quantity of air flowing into the cylinder pocket. On the Figure, the letter A denotes the spontaneously pumped-in air quantity, which is thus constant for a given machine speed. The air quantity Q flowing into the cylinder pocket naturally depends on the pressure P in the blowing box and the relationship between these parameters gives a curve with the running coordinates OP. For a given blowing box pressure $P_1$ the total quantity of air pumped into the air pocket is equal to $Q_1$.

FIG. 6 is the corresponding curve for a blowing box with angled blowing according to the invention, where the value A represents the spontaneously pumped-in air quantity in the pocket, while the value B denotes the air quantity pumped spontaneously out from the pocket. The curve with the running coordinates QP denotes, as previously, the total quantity of air pumped into the pocket as a function of the pressure in the blowing box, and it will be seen from the Figure that the total quantity of air pumped in decreases with increasing blowing box air pressure. In the Figure, the values $Q_2$ and $P_2$ represent a working point lying a distance below the spontaneously pumped-in air quantity, and where the difference in quantity between the pumped-in and pumped-out air has been decreased with the aid of the air quantity blown angularly towards the wire. In practice this signifies that the airflow in the transverse direction of the web has decreased, and thereby the risk of web flutter has also been reduced. From the Figure it will also be seen that the curve cuts the line B at a certain value for the blowing box air pressure, the line B corresponding to the spontaneously pumped-out air quantity, and in such a position the difference between pumped-in and pumped-out air quantity has been completely eliminated.

In FIG. 7 the airflows Q to and from the cylinder cavity have been illustrated as a function of the machine speed, here expressed in m/sec. similar to FIG. 5, the Figure illustrates the conditions in a blowing box with perpendicular blowing in accordance with the known art. The curve 2 represents spontaneously pumped-in air for a given type of wire, while curve 1 illustrates the spontaneously pumped-out air quantity. For a given machine speed $V_{m1}$, the difference flow A-B constitutes the imbalance flow for spontaneous ventilation of the wire. The curve 3 represents total airflow pumped in when using a blowing box 19 for conventional blowing, and the difference flow $Q_1-B$ thus constitutes the imbalance between the pumped-in and pumped-out flow in the conventional art.

FIG. 8 illustrates the same functions as in FIG. 7, although the wire has a higher permeability air, and blowing is done by a blowing box 9 in accordance with the invention. The curve 4 thus denotes the spontaneous pumping-in to the cylinder pocket, while the curve 5 represents the spontaneous pumping-out from the pocket. For a given machine speed $V_{m2}$, which is substantially higher than the machine speed $V_{m1}$ according to FIG. 7, the value A represents the spontaneous pumping-in, while the value B represents the spontaneous pumping-out. The airflow A-B thus constitutes the imbalance flow for spontaneous ventilation of the air pocket. The curve 6 shows the total pumping-in into the pocket while utilizing a method in accordance with the invention, and a point can thus be found for a given machine speed $V_{m2}$ where the total pumping-in $Q_2$ to the cylinder pocket matches the spontaneous pumped-out airflow which also signifies that balance has been obtained at the points $Q_2$, $V_{m2}$.

Two parameters can thus be varied to obtain a suitable balance point for a given machine speed, namely the pressure at the blowing box and the wire permeability. A greater air quantity to the pocket can only be provided by changing to a wire with greater permeability which allows a greater airflow through it. If the wire permeability increases, the spontaneous ventilation also increases, however, which signifies that the use of conventional technique would result in much too great imbalance flows and thereby risk for web flutter. As will be seen from FIG. 8, the ventilation air quantity to the cylinder pocket can be reduced in accordance with the invention even if a highly permeable wire is used, at the same time keeping the imbalance flow between pumped-in and pumped-out air within acceptable values, i.e. so that the transverse velocity of the air current does not become too high and thereby cause web flutter. One consequence of the invention is that with the aid of this technique, the machine speed can be substantially increased without risk of web flutter occurring.

We claim:

1. Apparatus for ventilating cylinder pockets in a cylinder dryer including a plurality of heated cylinders about which a web-like material is taken in zig-zag mode, an endless Fourdrinier wire and return rolls positioned to press the material against certain of the heated cylinder surfaces, cylinder pockets being formed between the cylinders, web and wire when the latter relinquishes contact with the web along a separation line at a cylinder surface, to pass over an intermediate return roll arranged between the cylinders, and to make contact once again with the web along a closing line at the next consecutive cylinder circumference, the separation effected by relinquishing contact in part producing spontaneous flow into the pocket through said wire and the closing action effected by making contact once again in part producing spontaneous flow out from the pocket, said inflow being normally greater than said outflow to produce an air current transverse to the web and exhausting beyond the edge of the web, said apparatus including at least one blowing box disposed adjacent said separation line outside the cylinder pocket extending over the width of the wire, and provided with blowing orifices placed between said intermediate return roll and the said separation line where the wire relinquishes contact with the web, and barrier means on said blowing box comprising a lip of yielding material connected to the blowing box projecting outwardly therefrom with its free edge engaging against the peripheral surface of said intermediate return roll along its generatrix, at least some of the blowing orifices of the blowing box being directed such that drying air is caused to flow towards the wire in a direction forming an acute angle to, and in a direction substantially counter to the direction of travel of the wire, the flow through said orifices cooperating with said barrier means to create a reduction in pressure between said separation line and said intermediate return roll to reduce the spontaneous flow into the pocket relative to the spontaneous flow out from the pocket and thereby reduce the air current transverse to the web exhausting beyond the edge of the web, said barrier means also preventing an interface layer of wet air around the intermediate return roll periphery from being introduced into the cylinder pocket on rotation of the roll.

2. Apparatus as claimed in claim 1, characterized in that the blowing orifices of the blowing box are formed as louvre-type or eyelid perforations, and in that the box is subdivided into sections over the width of the web, drying air being individually suppliable to said sections and wherein the air quantity is adjustable to enable regulation of the web drying profile.

* * * * *